United States Patent [19]

Langner

[11] Patent Number: 4,769,211

[45] Date of Patent: Sep. 6, 1988

[54] PROCESS FOR COMPACTING IRON PARTICLES AND SUBSEQUENT BREAKING APART OF THE COMPACTED IRON BAND AND APPARATUS FOR PERFORMING THIS PROCESS

[75] Inventor: Klaus Langner, Meerbusch-Osterrath, Fed. Rep. of Germany

[73] Assignee: Korf Engineering GmbH, Fed. Rep. of Germany

[21] Appl. No.: 89,901

[22] Filed: Aug. 27, 1987

Related U.S. Application Data

[63] Continuation of Ser. No. 833,042, Feb. 26, 1986, abandoned.

[30] Foreign Application Priority Data

Feb. 27, 1985 [DE] Fed. Rep. of Germany ..... 3509616

[51] Int. Cl.[4] ..... B22F 3/02; B26F 3/02

[52] U.S. Cl. ..... 419/3; 419/28; 419/43; 419/44; 419/69; 29/413; 225/96.5

[58] Field of Search ..... 419/2, 3, 28, 33, 43, 419/44, 67, 69; 266/137; 29/413; 425/79; 225/96.5

[56] References Cited

U.S. PATENT DOCUMENTS

| | | | |
|---|---|---|---|
| 2,994,917 | 8/1961 | Fritsch | 419/43 |
| 3,095,262 | 6/1963 | Maish et al. | 419/69 |
| 3,122,434 | 2/1964 | Reed et al. | 425/79 |
| 3,986,869 | 10/1976 | Oishi et al. | 428/553 |
| 4,165,978 | 8/1979 | Sanzenbacher et al. | 75/3 |
| 4,196,891 | 4/1980 | Sanzenbacher et al. | 266/137 |
| 4,605,599 | 8/1986 | Penrice et al. | 428/665 |
| 4,610,725 | 9/1986 | East et al. | 75/228 |

*Primary Examiner*—John F. Terapane
*Assistant Examiner*—Eric Jorgensen

[57] ABSTRACT

A process for the passivating, multistage compaction of hot iron particles supplied in the form of a packed bed from a reduction unit and for the subsequent breaking apart of the compacted iron band is described. Prior to the final compacting, the iron particles pass through a homogenizing and precompressing stage. Thus, the compacted iron has a pore volume of max. 40% and a density of at least 5.5 g/cm$^3$. The iron compacted to a band is subsequently guided between the rollers (7,8,11) of a separating stage exposing it to bending stresses such that it breaks apart at the predetermined desired breaking points. The latter have a smaller density than the band regions between them. They can be produced in that in the precompression stage the feed speed is briefly decelerated compared with the feed speed in the compaction stage or in the compaction stage there is less marked compression at these points than in the intermediate regions.

9 Claims, 5 Drawing Sheets

Figure 1:
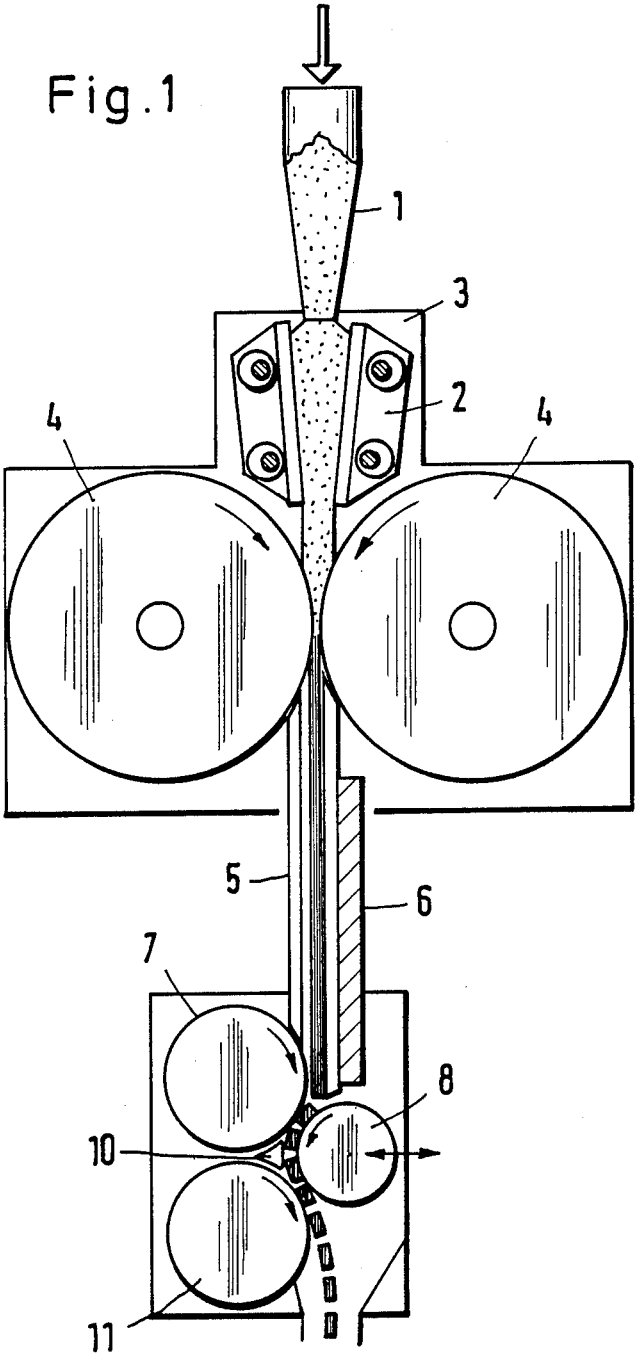

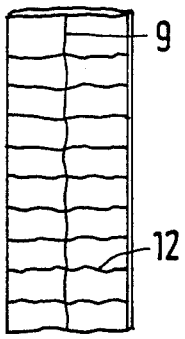
Fig. 2
Fig. 3
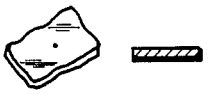
Fig. 4
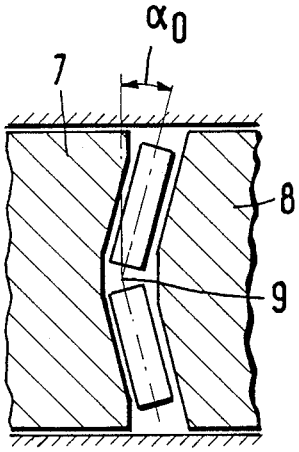
Fig. 5
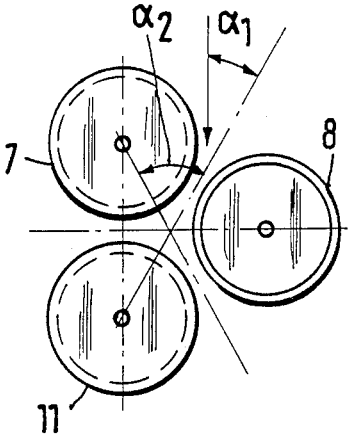

PROCESS FOR COMPACTING IRON PARTICLES AND SUBSEQUENT BREAKING APART OF THE COMPACTED IRON BAND AND APPARATUS FOR PERFORMING THIS PROCESS

This application is a continuation, of application Ser. No. 833,042, filed Feb. 26, 1986 now abandoned.

The invention relates to a process for compacting iron particles and subsequent breaking up of the compacted iron band.

Iron particles, particularly sponge iron, as a product of the direct reduction process have the property of binding oxygen due to their very high porosity. This process only takes place relatively slowly at temperatures below 120° C., whereas at higher temperatures the reoxiation rate increases and leads to a so-called "wild" reoxidation in a packed bed at temperatures above 220° to 250° C., in which the heat produced can generally no longer be removed in an adequate quantity, so that the process fails. The aim is therefore to passivate the sponge iron against oxygen uptake and consequently minimize the metallization losses.

If the sponge iron is further processed as a cooling medium in smelting processes or as a scrap substitute in electric furnaces, the relatively low density of the sponge iron compared with scrap is disadvantageous, because this leads to a lower electrical conductivity of the sponge iron or the latter floats on a melt.

Thus, prior to its further processing, the aim is to both passivate and compact the sponge iron. The best known processes for treating sponge iron are hot briquetting, cold briquetting, Chemaire passivation, discontinuous air passivation and aging.

The three first-mentioned processes lead to an adequate protection against reoxidation by moist air or fresh water, whereas the two latter processes only provide adequate protection against moist air. Only the first-mentioned process provides a limited protection against reoxidation by sea water, in that the pore volume is considerably compressed. However, an absolute protection is not provided, because the briquettes from the hot briquetting process, although having a very dense surface, are still relatively porous in the interior.

Fracture points or fragments of the thus obtained briquettes are not resistant to sea water in the sense of a passivation. Over the past few years test series have been performed for providing criteria for defining the term "passivation". Thus, a sponge iron is considered to be passivated if the oxygen uptake is no more than 0.01 $Nm^3$ $O_2$/t/day. This evaluation applies to the moistening of a packed bed with water at approximately 23° C.

A process for compacting and passivating sponge iron is known from German Pat. No. 26 25 223. Hot iron particles are compressed between two oppositely rotating smooth rollers to give an endless strand, which is subsequently comminuted by means of shearing rollers and a chopping roller. In this process, the smoothing rollers produce a band in one operation from a packed bed with a high void or gap volume and whose internal structure is not yet adequately compressed in the sense of the passivity with respect to oxygen, so that during comminution by the subsequent shearing process the edges must be "closed". As a result of this considerable stressing, the service life of the shear edges is only relatively small, which prevents a large scale industrial use of this process.

U.S. Pat. No. 2,287,663 also discloses a process for compacting iron particles. In this process, compression takes place in two stages, so that the pore volume of the briquette can be further reduced. However, this known process fails to solve the problems occurring in connection with the separation of the compacted iron band. Thus, e.g. expensive mould tools or dies are required. It is also necessary to have a speed matching between the positive first compression stage and the non-positive second compression stage. It is in particular necessary to avoid band fractures between the two stages, because such phenomena frequently occur during the compression of the loose packed bed of metalized sponge iron in the form of pellets or the like.

The problem of the present invention is therefore to provide a process for the passivating, multistage compaction of hot iron particles supplied in the form of a packed bed from a reduction unit and subsequent breaking apart of the compacted iron band, in which the compressed iron has a pore volume of less than 40%, independently of the number and configuration of the fracture lines, as well as a density of at least 5 g/$cm^3$, i.e. it is passivated in the above sense, whilst expensive mould tools and dies not being required as in the case of briquette manufacture and in which finally the proportion of small-sized fracture is kept small through not using impact energy in the separation of the compacted iron band.

The process according to the invention is characterized in that prior to the final compacting, the iron particles pass through a gomogenizing and precompressing stage and that the iron compacted to a band on passing between rollers is exposed to bending stresses bringing about the breaking apart at desired breaking points. Appropriately there is a comprssion of the packed bed by at least 20% by volume in the homogenizing and precompressing stage. Advantageously the desired breaking points are produced either in the homogenizing and precompressing stage by a reduced speed conveying of the packed bed or during the final compaction by reduced compression of the iron at these points. For the purpose of breaking apart the iron band, this advantageously undergoes a deflection of at least 15% in its forward movement. For breaking apart the iron band into at least two strips, said band can be additionally bent in its longitudinal direction at an angle of at least 30° between the strips.

In a preferred apparatus for performing the process, the homogenizing and precompressing stage has two plates defining the packed bed, which simultaneously perform an oppositely directed movement at right angles to the feed direction and also a movement in the feed direction. The movement of the plates in the feed direction can be the same, smaller or larger than the circumferential speed of the rollers bringing about the final compacting of the iron.

The invention is described in greater detail hereinafter relative to embodiments represented in the drawings, wherein show:

FIG. 1A first embodiment of an apparatus for compacting iron particles and the subsequent breaking up of the compacted iron band.

FIG. 2 A compacted iron band with the fracture lines occurring during breaking up.

FIG. 3 A sheel or scab produced during the breaking up of the band in a perspective view and in crosssection.

FIG. 4 The sectional profile of two facing rollers in the separation stage, viewed in the feed direction.

FIG. 5 An arrangement of the rollers in the separation stage with the relevant deflection angles.

Figure 6:
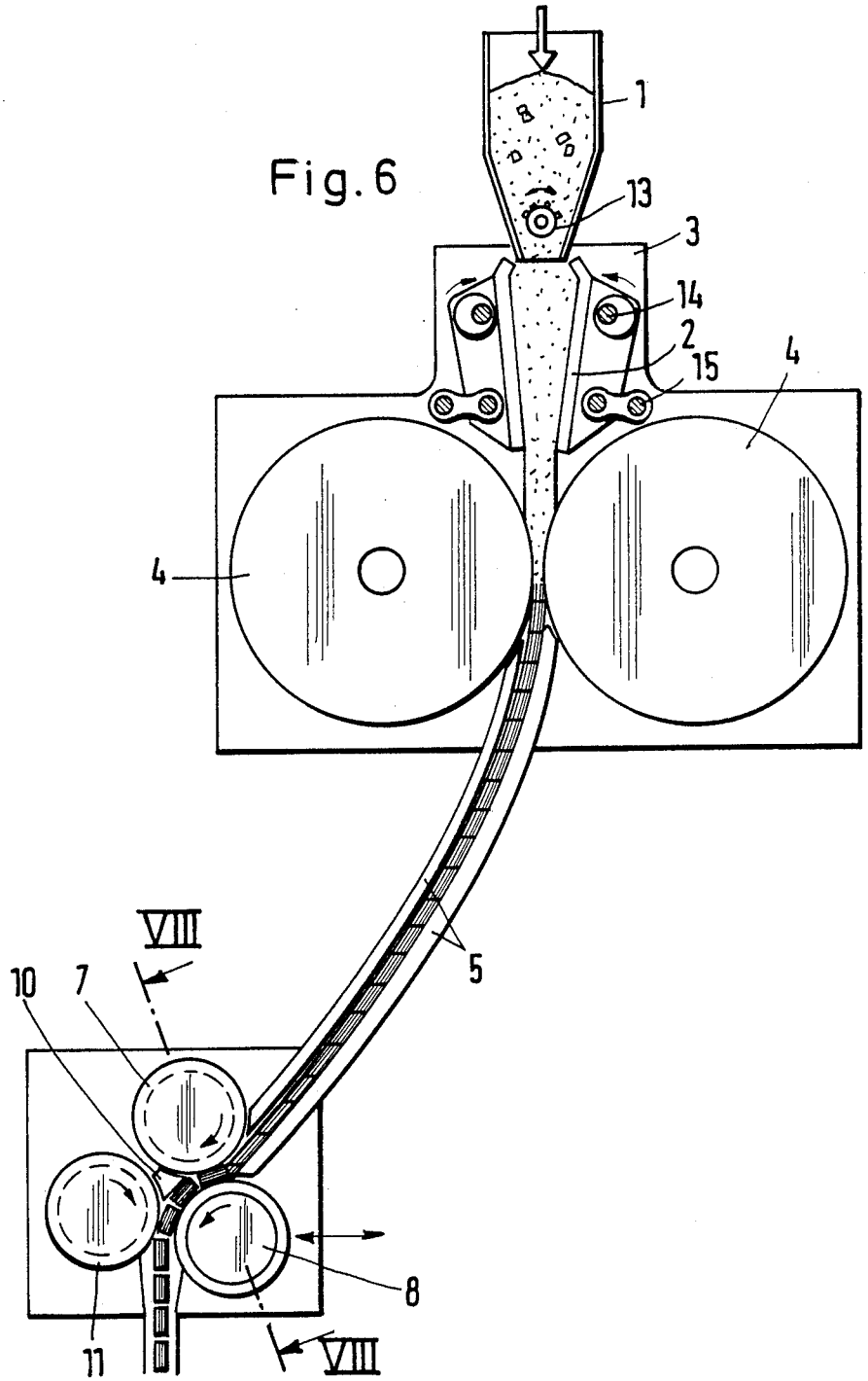

FIG. 6 A second embodiment of an apparatus for compacting iron particles and for breaking up the compacted iron band.

Figure 7:
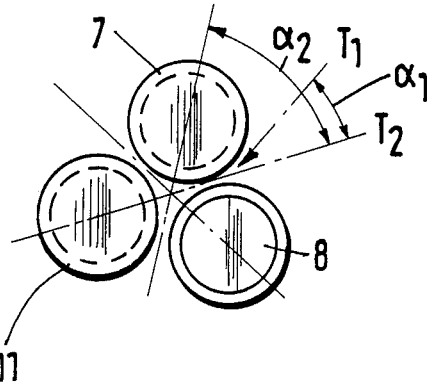

FIG. 7 The arrangement of the rollers in the separation stage in the apparatus according to FIG. 6 with the relevant deflection angles.

Figure 8:
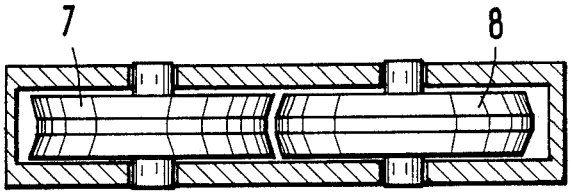

FIG. 8 A section along line VIII—VIII of FIG. 6.

Figure 9:
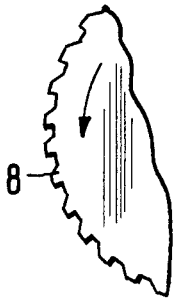

FIG. 9 The circumferential profile of a roller in the separation stage.

Figure 10:
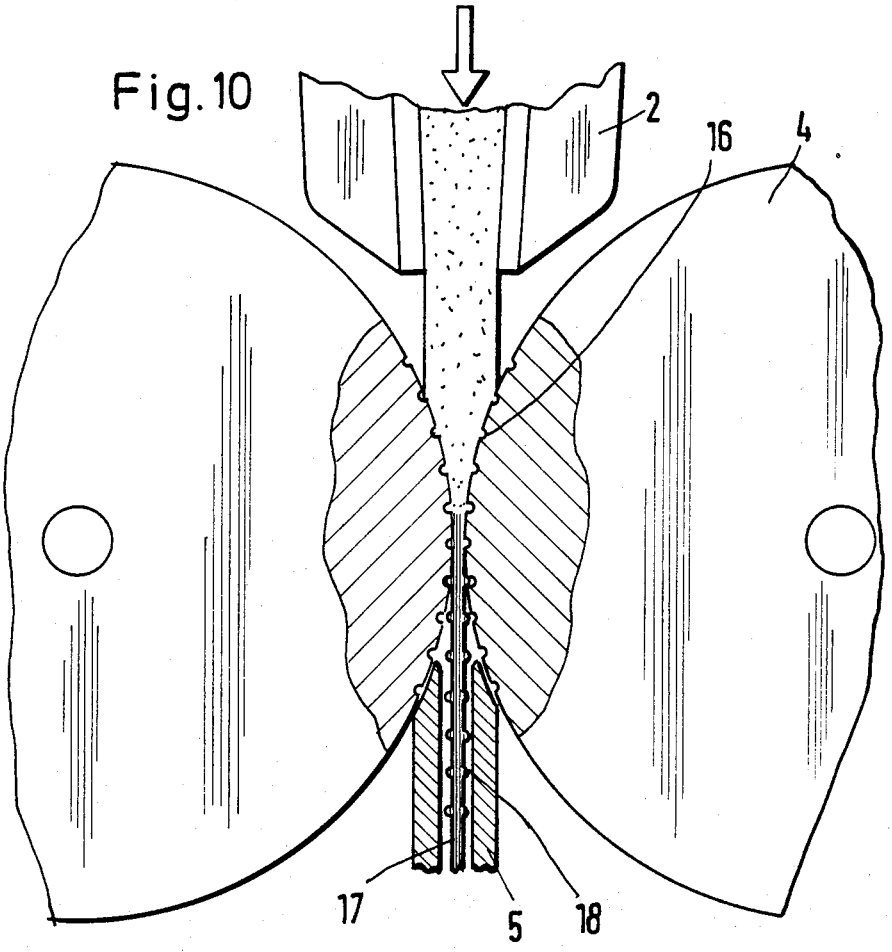

FIG. 10 A compacting stage according to a further embodiment.

Figure 11:
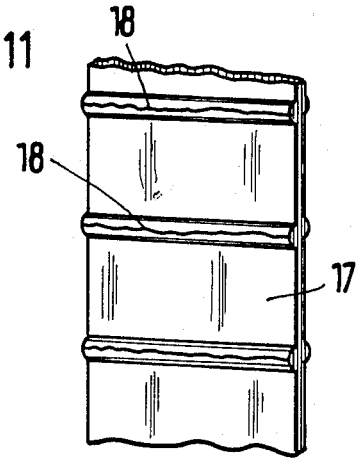

FIG. 11 The view of an iron band produced in the compacting stage according to FIG. 10.

The apparatus according to FIG. 1 has a hopper 1, into which the particulate, metallized product is introduced in the direction of the arrow at a temperature of more than 700° C. This product, e.g. sponge iron, is then fed to a homogenizing and precompressing stage, which has two facing plates 2, which rotate in opposite directions. This movement is preferably produced by an eccentric drive. By means of lateral limiting jaws 3 running at right angles to plates 2 the particulate product is held in such a way that a force at right angles to the vertical feed direction is produced by the movement component of plates 2 and this is adequate for reducing the void volume of the product. At the time of the maximum force action of plates 2 on the packed product bed, there is simultaneously a plate movement in the feed direction, which is either adapted to the circumferential speed of the following rollers used for compaction purposes or is below this. If the speed of the downward movement of the plates 2 is lower than the circumferential speed of rollers 4, then in the iron band produced by said rollers are formed clearly defined desired breaking points at right angles to the feed direction and which have a lower compression. At these desired breaking points, the band is subsequently broken apart in the horizontal direction. The movement of plates 2 in the feed direction can also have a higher speed than the circumferential speed of rollers 4, so that a positive feed pressure is exerted on the packed bed.

The packed bed has to be compressed by at least 20% by volume in the precompression stage. The thus compacted, band-like packed bed is then supplied to rollers 4 for final compaction. These rollers 4 can have a smooth surface or can be provided with groove-like depressions for increasing the draw-in capacity and for producing desired breaking points. Theyrotate in opposite directions and continuously compress the metallized product to a homogenized band with an average density of at least 5.5 g/cm$^3$. This density is adequate to protect the product against significant metallization losses, even when stored for a long time in the open. It is unimportant whether the individual bodies into which the band is subsequently broken up have "open" fracture edges or not. Compared with the smooth, very dense surface resulting from the rolling process, the fracture edges at right angles to the structure are admittedly more porous, but with a density of 5.5 g/cm$^3$ the structure at said fracture edges is also adequately compressed to ensure passivation with respect to oxygen. In order to achieve this high degree of density, it is absolutely necessary to precompress the loose packed bed prior to the final compression by rollers 4.

The continuous band passing out of the gap between rollers 4 must be cooled to a temperature below 400° C. prior to the final separation. Only at such a temperature does the band have the necessary brittleness to enable fracture edges to form during the subsequent planned bending stressing. The cooling of the band takes place in the apparatus according to FIG. 1 in a transfer chute 5 by means of the injection of water.

When using vertical or sloping transfer chutes, it must be borne in mind that the product band occasionally tears away and the resulting fragments exceed the feed speed of the band as a result of their inherent acceleration and slide away over said band. As a rule, this process leads to blockages. In order to eliminate this deficiency, a magnet 6 is provided enabling any fragments in the transfer chute 5 to be decelerated in such a way that their speed of fall is no greater than the feed speed of the band and they are moved by the following band section to the separation stage.

After passing through the transfer chute 5, the product band is taken up by the separation rollers 7,8 which have the surface profile shown in FIG. 4. Thus, in the longitudinal direction, the band is centrally bent by the angle $\alpha_o$ and if this angle exceeds 15°, then the corresponding bending forces generally lead to a vertical fracture line 9 (FIG. 2) in the longitudinal direction of the band.

The longitudinally divided band then undergoes a deflection corresponding to the angle $\alpha_1$ in the feed direction (FIG. 5), so that in the transverse direction the band is exposed to a force action, which leads to a fracture andat least to cracking, if $\alpha_1$ is equal to or larger than 15°. By means of a stripper 10, the band is then guided between the separating roller 8 and a further separating roller 11 facing the same, so that the at least torn band at the desired breaking points in the transverse direction undergoes a deflection in the opposite direction by angle $\alpha_2$. If no fracture has taken place, the band is broken along the horizontal fracture lines 12 (FIG. 2) into the scabs or shells shown in FIG. 3.

The represented apparatus has the advantage that for separating the band there is no need for impact energy, so that there is no excessive proportion of small-sized fracture. In addition, the non-compacted or semi-compacted iron particles occurring on starting up can be easily removed through the permanently open roller gap. If dust formation occurs in individual cases, then by a rapid stroke in the direction of the arrow, the separating roller 8 can be moved out. It is particularly advantageous that there is no need for absolute synchronism between the rollers 4 carrying out compacting and the separating rollers 7,8,11, because the latter produce no self-closure and only a relatively small force-closure with respect to the band, so that a certain slip of the band with respect to the separating rollers is possible. Thus, preferably the circumferential speed of the separating rollers is slightly greater than the circumferential speed of rollers 4.

In the apparatus according to FIG. 6 a roller 13 provided with teeth is located in the lower region of hopper 1 and comminutes agglomerates from the supplied pellets or the like. It also produces a positive feed pressure in the feed direction if the circumferential speed of the roller teeth is higher than the product dropping rate.

A combination of an eccentric shaft 14 and an articulated lever 15 has been chosen as the drive for the plates 2 of the homogenizing and precompressing stage. Whilst the eccentric shafts 14 provide the forces necessary for precompression, the articulated levers 15 keep the plates together at the lower end in such a way that during the return storke of the plates, the packed product from hopper 1 cannot be discharged from the bottom.

Whereas in the apparatus according to FIG. 1, the separating stage is located directly below the compacting stage, in the apparatus according to FIG. 6 there is a laterally displaced arrangement. In this case, the transfer chute 5 is in the form of a circular arc portion. This construction has the advantage that fragments torn away from the band after compacting are not subject to a free fall action and instead follow the curved path of the chute 5 and are correspondingly decelerated by friction. However, it is necessary to impart to the cohesive product band a curvature, so that it can follow the curvature of chute 5 in normal operation and without any significant friction loss. Such a curvature is produced in that the right-hand roller of the two rollers 4 has a lead, i.e. the speed of this roller is made slightly higher than the other roller. However, this "roller slip" is only possible in the case of smooth rollers.

A tangent $T_1$ applied to the outlet end of transfer chute 5 forms with the tangent $T_2$ applied in the contact point of the separating rollers 7 and 8, the intake angle $\alpha_1$ of the product band precurved corresponding to the curvature of chute 5, so that said band is deflected in the opposite direction by said angle in the feed direction. If there is no final breakage or fracture to the band, then this occurs due to the deflection brought about by separating rollers 8 and 11. The product band is broken apart in the longitudinal direction because, as shown in FIG. 8, separating roller 8 has a convex circumferential surface and at least the separating roller 7 has a concave circumferential surface. Also in the case of the apparatus according to FIG. 6, there is a cooling of the product band by water injection in transfer chute 5, so that its temperature on entering the gap betwen the two rollers 7,8 has dropped below 400° C. In order to increase the draw-in or gripping capacity of the separating rollers, the convexly shaped separating roller 8 can be given a toothed profile corresponding to FIG. 9.

In the embodiment according to FIG. 10, the rollers 4 have facing, axially directed grooves 16. The product band 7 resulting from compacting is consequently provided with bead-like protuberances 18 which, as the material is less markedly compressed there than in the intermediate zones, form the desired breaking points of band 17, so that the latter is broken apart at clearly defined points.

I claim:

1. Process for the passivating, multistage compacting of hot iron particles from a reduction unit supplied in the form of a packed bed and subsequent breaking apart of a compacted iron band formed from said hot iron particles, characterized by the steps of supplying the hot iron particles in a feed direction to a homogenizing and precompressing stage which includes a pair of facing plates and a lateral limiting jaw all located adjacent to the feed direction of the hot iron particle from the reduction unit, moving the facing plates toward each other to compress the hot iron particles, holding the hot iron particles between the facing plates using the lateral limiting jaw to compact the iron particles to a band, moving the facing plates away from each other and at the time the facing plates are exerting the maximum compressing force on the iron particles, moving the facing plates in the feed direction, finally passing said band between a pair of compacting rollers, rotating the compacting rollers to compact said band, moving the facing plates in the feed direction at a speed less than the circumferential speed of the compacting rollers to produce desired breaking points in said band having a lower density than the other areas of the band, and passing the band after final compacting thereof from the compacting rollers to a separation stage which includes separation rollers, operating the separation rollers to expose the band to bending stresses to bring about breaking apart of the band at said desired breaking points.

2. Process according to claim 1 characterized in that compression of the packed bed by at least 20% by volume takes place in the homogenizing and precompressing stage.

3. Process according to claim 2, characterized in that for breaking up the iron band, the latter undergoes an at least 15° deflection in its movement.

4. Process according to claim 3, characterized in that for breaking apart the iron band into at least two strips this is additionally bent in its longitudinal direction at an angle between the strips of at least 30°.

5. Process according to claim 2, characterized in that after finally compacting said band the iron band has a pore volume of max 40%.

6. Process according to claim 1 characterized in that for breaking up the iron band, the latter undergoes an at least 15° deflection in its movement.

7. Process according to claim 6, characterized in that for breaking apart the iron band into at least two strips this is additionally bent in its longitudinal direction at an angle between the strips of at least 30°.

8. Process according to claim 1, characterized in that after finally compacting said band the iron band has a pore volume of max. 40%.

9. Process for the passivating, multistage compacting of hot iron particles from a reduction until supplied in the form of a packed bed and subsequent breaking apart of a compacted iron band formed from said hot iron particles, characterized by the steps of supplying the hot iron particles in a feed direction to a homogenizing and precompressing stage which includes a pair of facing plates and a lateral limiting jaw all located adjacent to the feed direction of the hot iron particles from the reduction unit, moving the facing plates toward each other to compress the hot iron particles, holding the hot iron particles between the facing plates using the lateral limiting jaw to compact the iron particles to a band, moving the facing plates away from each other, and at the time the facing plates are exerting the maximum compressing force on the iron particles moving the facing plates in the feed direction, finally passing said band between a pair of compacting rollers, rotating the compacting rollers to compact said band, moving the facing plates in the feed direction at a speed greater than the circumferential speed of the compacting rollers to produce desired breaking points in said band having a lower density than the other areas of the band, and passing the band after final compacting thereof from the compacting rollers to a separation stage which includes separation rollers, operating the separation rollers to expose the band to bending stresses to bring about breaking apart of the band at said desired breaking points.

* * * * *